US006457526B1

(12) United States Patent
Dailey

(10) Patent No.: US 6,457,526 B1
(45) Date of Patent: Oct. 1, 2002

(54) SUB SEA BOTTOM HOLE ASSEMBLY CHANGE OUT SYSTEM AND METHOD

(75) Inventor: Terry M. Dailey, Humble, TX (US)

(73) Assignee: Halliburton Energy Services, Inc., Carrollton, TX (US)

( * ) Notice: Subject to any disclaimer, the term of this patent is extended or adjusted under 35 U.S.C. 154(b) by 0 days.

(21) Appl. No.: 09/705,197

(22) Filed: Nov. 2, 2000

Related U.S. Application Data

(60) Provisional application No. 60/163,159, filed on Nov. 2, 1999.

(51) Int. Cl.[7] ..... E21B 33/038
(52) U.S. Cl. ..... 166/338; 166/356; 166/360
(58) Field of Search ..... 166/338–340, 166/356, 360, 367

(56) References Cited

U.S. PATENT DOCUMENTS 4,010,798 A 3/1977 Corgnet
4,054,104 A 10/1977 Haselton
4,147,221 A 4/1979 Ilfrey et al.
4,201,074 A * 5/1980 Cox ..... 72/168
4,502,551 A 3/1985 Rule et al.
4,617,998 A * 10/1986 Langner ..... 166/345
4,708,563 A 11/1987 Van Den Berg et al.
4,753,552 A 6/1988 Karal et al.
4,762,185 A * 8/1988 Simpson ..... 175/5
5,098,219 A 3/1992 Harrington
5,875,848 A 3/1999 Wolff et al.

* cited by examiner

*Primary Examiner*—William Neuder
*Assistant Examiner*—Zakiya Walker
(74) *Attorney, Agent, or Firm*—Carlos A. Torres; Browning Bushman PC

(57) ABSTRACT

The components required for changing out a bottom hole assembly are stored within a submerged storage chamber adjacent the lower end of a riser extending up from the bottom of a body of water. A vertical, revolving magazine holds the bottom hole assembly components within the storage chamber. A pressure lock between the storage chamber and the interior of the riser is opened to permit the bottom hole assembly components in the chamber to be exchanged with those forming the drilling string assembly within the riser. The storage chamber may be selectively sealed from the body of water and the internal riser area as the bottom hole assembly components are moved into and out of the chamber. A remotely operated mechanism assembles and disassembles the bottom hole assembly components of the drilling string assembly.

31 Claims, 2 Drawing Sheets

R
S
10
16a
14
12
12a
17
13
A
B
C
D
16
11
11a
ML
C
W

FIG. 2
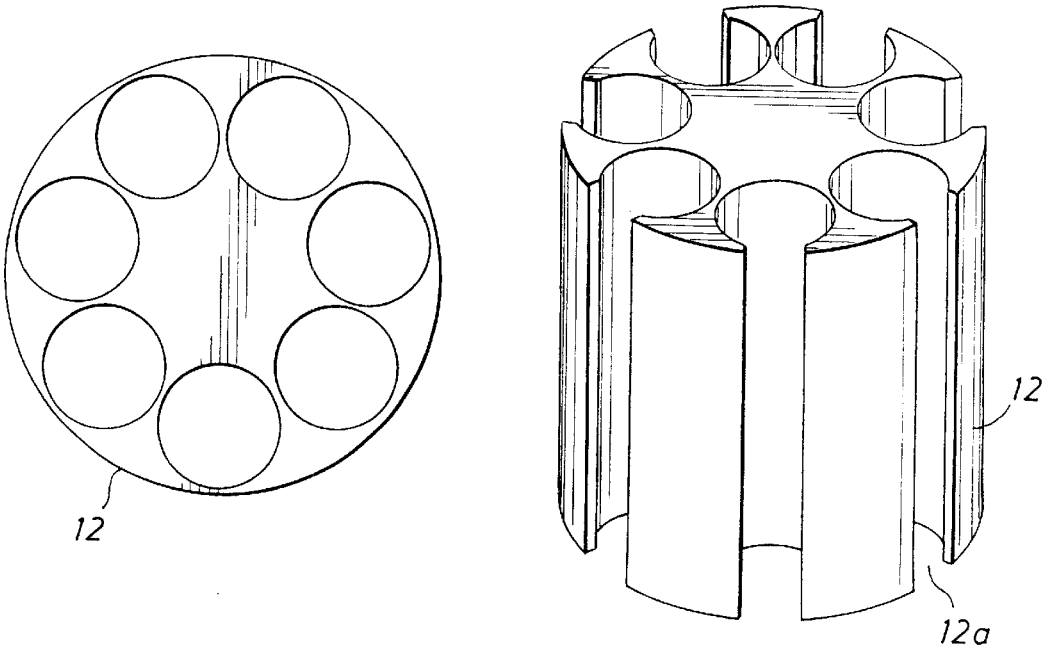
FIG. 3
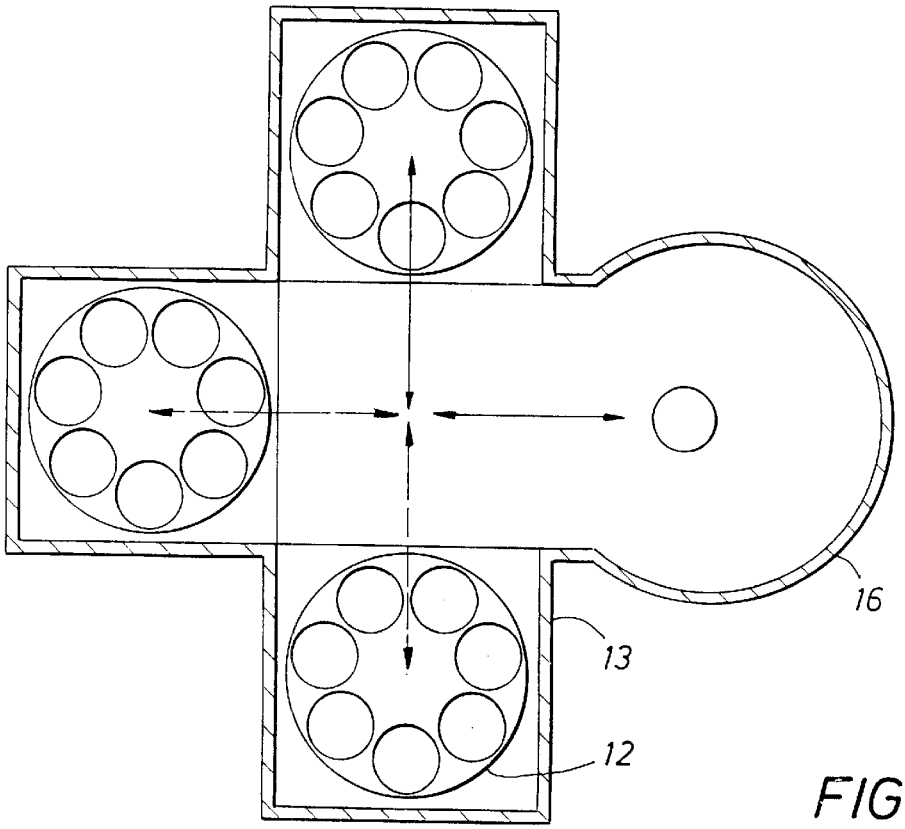
FIG. 4

SUB SEA BOTTOM HOLE ASSEMBLY CHANGE OUT SYSTEM AND METHOD

CROSS REFERENCE TO RELATED APPLICATIONS

This application is related to and claims the benefit of the filing date of U.S. provisional application Ser. No. 60/163,159 filed Nov. 2, 1999.

BACKGROUND OF THE INVENTION

1. Field of the Invention

The present invention relates generally to the drilling of wells through a body of water. More particularly, the present invention relates to a system and method for changing out the components of a drill string assembly used to drill wells through a body of water without retrieving the components being changed out to the surface of the body of water.

2. Background Setting of the Prior Art

During the construction of a well, it is necessary to replace the components included in the bottom hole assembly (BHA) carried at the lower end of the drill string. The BHA typically includes a drill bit, stabilizers and drill collars. In directionally drilled wells, it is also common for the BHA to include a drilling motor, measurement while drilling equipment, logging while drilling and other down hole tools. Replacement or repair of the BHA normally requires retrieving the entire string to the drilling floor of the drilling rig.

A great deal of drilling rig time may be required to retrieve the BHA from the well to the surface of the water for replacement or repair. Deepwater wells are currently being drilled through water depths that approach and may even exceed 10,000 ft. In a drill string assembly having a measured length of 30,000 ft., the portion of the drill string assembly extending between the water bottom, or "mud line," to the water body surface may be 30% or more of the total string length. The expense in operating deep water drilling rigs is very high, in some cases exceeding $240,000 per day. Any time that can be saved during the construction of the well contributes significantly in reducing the cost of the well.

SUMMARY OF THE INVENTION

A submerged storage chamber containing BHA components is positioned at the mud line in contact with the base of the riser extending from a blowout preventer to the surface drilling rig. The BHA components in the storage chamber are held within a vertically mounted, rotatable magazine. The submerged chamber includes access doors into the body of water and into the interior of the riser. Pressure between the chamber and the interior of the riser is equalized to permit opening of an access door for transfer of the BHA components between the magazine and the BHA of the drilling string. Automated equipment in the chamber and operating within the riser remove the BHA components from the drill string and replace them with BHA components removed from the rotatable magazine. Pressure between the chamber and the water body is equalized to permit opening of an outside access door for transferring the magazine between the drilling rig and the chamber.

From the foregoing it will be appreciated that a primary object of the present invention is to provide a system and method for changing out the BHA in a well being drilled through a deep body of water without the need to retrieve the BHA to the drilling rig operating at the surface of the water.

The foregoing objects, features and advantages of the present invention, as well as others, will be better understood and more fully appreciated by reference to the following drawings, specification and claims.

BRIEF DESCRIPTION OF THE DRAWINGS

FIG. 2 is a schematic plan view of a vertical, rotary magazine of the present invention;

FIG. 3 is a schematic representation, in perspective, illustrating a vertical rotary magazine of the present invention; and FIG. 4 is a plan view schematically illustrating a modified form of the BHA change out system of the present invention employing multiple rotary magazines.

DESCRIPTION OF THE ILLUSTRATED EMBODIMENTS

Figure 1:
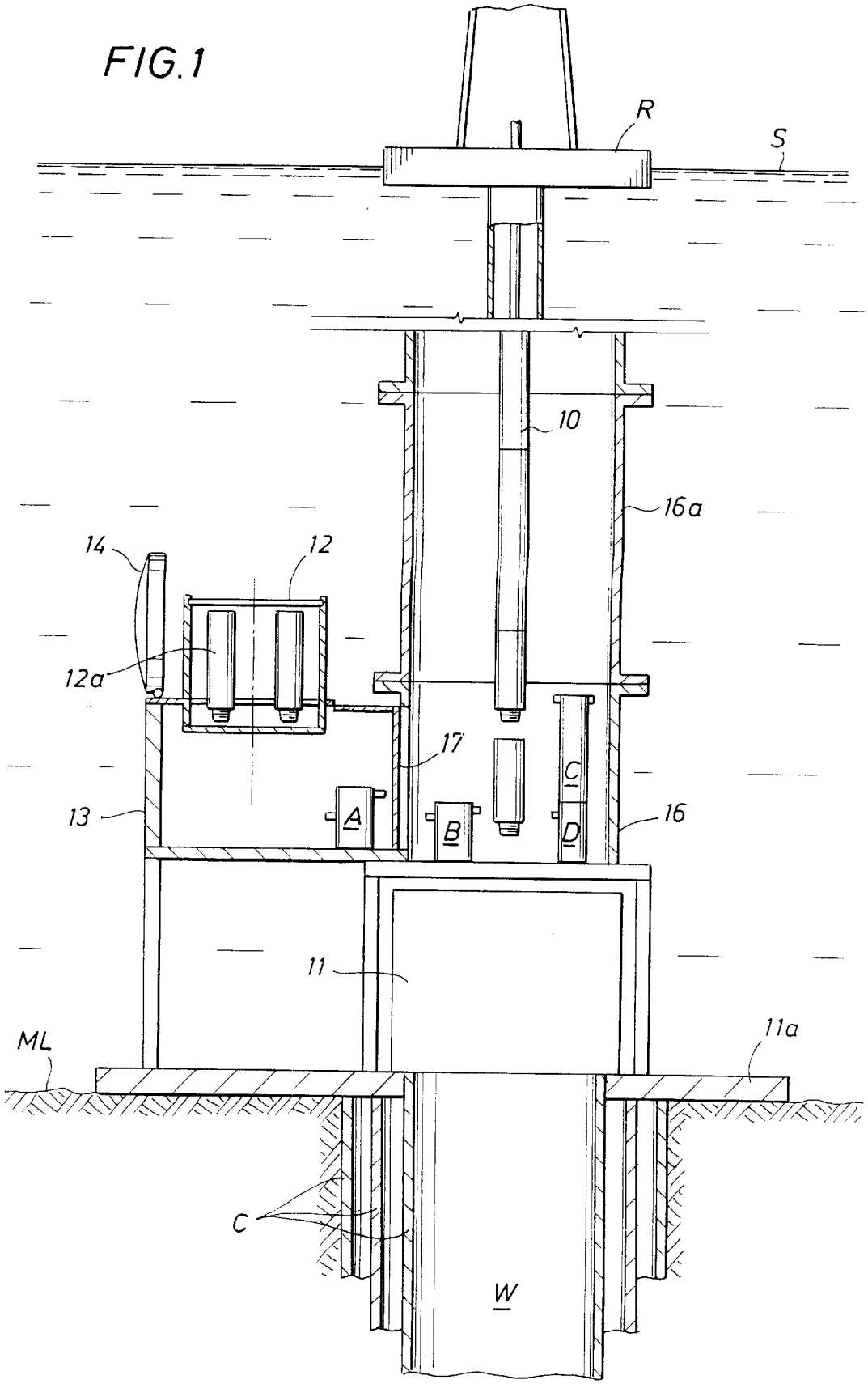
FIG. 1 is a schematic representation of the change out system of the present invention illustrating a subsea lockout chamber receiving a vertical rotary magazine containing replacement BHA components.

With reference to FIG. 1, a special 40 ft. long riser section 16 sits atop a bag type subsea blowout preventer (BOP) system 11 and connects to the oilfield standard marine riser 16a that leads to the drilling rig R at the water surface S. The subsea BOP rests atop a mud line suspension system or template 11*a* that in turn rests on the mud line (ML). Casing strings C extend from the template 11*a* into the well bore. A drill collar portion 10 of a BHA forming part of the drill string assembly being used to drill the well W is illustrated extending from the special riser section 16 to the drilling rig R.

A subsea lockout chamber 13 connects into the special riser section 16 through a vertical sliding hatch 17. The lockout chamber 13 is also 40 ft. in vertical height to correspond with the riser Section 16. The chamber 13 receives a vertical rotary magazine 12 that carries BHA components within the individual chambers of the magazine. The special riser section 16 allows the loading and unloading of the vertical rotary magazine into the oilfield standard marine riser system 16*a*. The vertical rotary magazine 12 is used to transport, handle, protect, load, unload, and store the various BHA components between the drilling rig at the water surface and the seabed. A movable hatch 14 designed to selectively seal the chamber 13 may be opened to permit access for moving the magazine 12 into and out of the chamber.

Suitable, remotely operated tools, A, B, C, and D provided in the subsea chamber 13 and special riser section 16 are employed to make up and break out the BHA components and to transfer the components between the BHA of the drill string and the chambers of the magazine. The tools, A, B, C, and D are conventional and are not, per se, part of the present invention. Automatic make up and break out equipment and transfer equipment such as the Varco® "Iron Roughneck" is exemplary of equipment suitable for performing the makeup, breakout and transfer functions performed during the changing out of the BHA in the system and method of the present invention.

In operation, before the string is pulled, the vertical rotary magazine 12 is loaded into the lockout storage chamber 13 through the top movable hatch 14. The movable hatch 14 is closed and the seawater is displaced from the storage chamber 13. The BHA, including the drill collar 10, is then pulled out of the well W in the current conventional industry manner. This process continues until the last component, usually the drill bit (not illustrated), is completely above the subsea BOP stack 11. The bag type BOP 11 is then closed in the normal manner to seal off the well W, thus isolating the well from the area contained within the riser 16.

The drilling fluid in the standard marine riser 16*a* is slowly bled into the subsea lockout chamber 13, equalizing the pressure between the riser and the chamber 13. After the pressure is equalized, the vertical sliding door 17 connecting the riser and the chamber 13 is opened. This allows the various components (bits, drill collars, heavyweight drill pipe, motors, etc.) located within the vertical magazine 12 access to the inside of the standard marine riser 16.

A remotely operated hydraulic pipe and torque and handling system, A, B, C and D, is used to screw and unscrew the various connections in the down hole drilling components, load and unload them as needed into the vertical rotary magazine 12 and then assemble the various components together in the drill string assembly in the desired order.

Upon completion of the component switch out, rearrangement or bit change, the vertical sliding hatch 17 is closed and the drilling fluid in the chamber 13 is transferred back into the marine riser 16. Seawater is then bled into the chamber 13, equalizing the pressure between the chamber and the sea. The drill string assembly with components assembled from the magazine 12 may then be run into the well W to resume the well construction.

The vertical rotary magazine 12 may be brought to the surface with the replaced components when desired. The vertical rotary magazine may be equipped with buoyancy tanks to assist in the controlled submerging and resurfacing of the magazine.

FIG. 2 illustrates a top view of a rotary magazine 12 of the present invention having seven separate chambers for receiving BHA and other drill string components.

FIG. 3 is a perspective view of a magazine 12 of the present invention illustrating access openings 12*a* extending from the side of the magazine to permit side access to the components carried within the magazine chambers for transferring the components to the drill string assembly area.

FIG. 4 is a plan view of the assembly of the present invention illustrating three separate chamber sections containing magazines 12. The magazines are movable to a central area that communicates with the riser 16. The central area may also accommodate the remotely operated handling equipment A, B, C, and D used to assemble, disassemble and transfer components between the magazines and the drill string assembly.

While preferred embodiments of the inventions have been illustrated herein, it will be appreciated that various changes in the details and materials of construction and the method steps may be made without departing from the spirit and scope of the present inventions, which are more fully defined in the following claims.

What is claimed is:

1. An underwater change out system for changing out well construction components in a well being drilled from the surface of a body of water, comprising:

a blowout preventer adapted to be positioned near a mud line in said body of water for maintaining pressure control in said well, a tubular riser assembly extending from said blowout preventer toward said surface of said body of water, an underwater storage chamber connected with said tubular riser assembly in an area between said blowout preventer and said surface of said body of water, a closeable entry between said storage chamber and said tubular riser assembly for selectively communicating or isolating said storage chamber and an internal area of said tubular riser assembly, and a transfer mechanism for moving well construction components between said internal area of said tubular riser assembly and said storage chamber.

2. An underwater change out system as defined in claim 1 wherein said transfer mechanism comprises a rotary magazine.

3. An underwater change out system as defined in claim 2 wherein said rotary magazine is adapted to store components of a drilling assembly.

4. An underwater change out system as defined in claim 2 wherein said rotary magazine is contained within said storage chamber.

5. An underwater change out system as defined in claim 4 wherein said rotary magazine is adapted to store drill collars.

6. An underwater change out system as defined in claim 4 wherein said rotary magazine is adapted to store the components of a bottom hole assembly.

7. An underwater change out system as defined in claim 6 further comprising an entry hatch for delivering well construction components into said storage compartment.

8. An underwater change out system as defined in claim 7 further comprising a pressure equalization device for equalizing the pressure within said storage compartment with that of said body of water.

9. An underwater change out system as defined in claim 8 wherein said transfer mechanism comprises a vertical rotary magazine having multiple equipment receiving receptacles.

10. An underwater change out system as defined in claim 1 wherein said storage chamber includes pressure-changing devices for changing the pressure within said storage chamber.

11. An underwater change out system as defined in claim 1 further comprising multiple underwater storage chambers connected with said tubular riser assembly in said area between said blowout preventer and said surface of said body of water.

12. An underwater change out system as defined in claim 11 further comprising transfer mechanisms in each of said multiple underwater storage chambers for transferring well construction components between said multiple underwater storage chambers and an internal area within said tubular riser assembly.

13. An underwater change out system as defined in claim 1 further comprising a remotely operated makeup and break out mechanism for adding or removing threaded components from a well construction assembly.

14. A method of changing out a bottom hole assembly in a well being drilled through a body of water, comprising:

depositing an equipment holding mechanism containing well construction equipment into an underwater storage chamber connecting to a drilling riser, sealing the underwater storage chamber from the water of said water body, transferring well construction equipment from said equipment holding mechanism into an area communicating internally with said drilling riser, and changing out a bottom hole assembly with said well construction equipment.

15. A method as defined in claim 14 further comprising equalizing the pressure in the area internally of said drilling riser with that of the underwater storage chamber.

16. A method as defined in claim 15 further comprising forming a pressure seal between said underwater storage chamber and the area internally of said drilling riser.

17. A method as defined in claim 16 further comprising threadedly engaging well construction equipment transferred from said equipment holding mechanism with a drilling assembly extending into a well bore within said area internally of said drilling riser.

18. A method as defined in claim 17 wherein the pressure in said storage chamber is equalized with that of said area communicating internally with said drilling riser when said well construction equipment is being transferred from said equipment holding mechanism into said area communicating internally with said drilling riser.

19. A method as defined in claim 14 wherein said equipment holding mechanism is a vertical rotary magazine.

20. A method as defined in claim 19 wherein said rotary magazine is transported between a surface of said body of water and said storage chamber.

21. A method as defined in claim 20 wherein the pressure in said storage chamber is equalized with that of said body of water when said magazine is being introduced to or removed from said storage chamber.

22. A method as defined in claim 21 wherein the pressure in said storage chamber is equalized with that of said area communicating internally with said drilling riser when said well construction equipment is being transferred from said equipment holding mechanism into said area communicating internally with said drilling riser.

23. A method as defined in claim 22 wherein said equipment holding mechanism is a vertical rotary magazine.

24. A method as defined in claim 23 further comprising threadedly engaging well construction equipment transferred from said equipment holding mechanism with a drilling assembly extending into a well bore within said area internally of said drilling riser.

25. A method as defined in claim 14 wherein the pressure in said storage chamber is equalized with that of said area communicating internally with said drilling riser when said well construction equipment is being transferred from said equipment holding mechanism into said area communicating internally with said drilling riser.

26. A method of changing out a bottom hole assembly in a drill string being used to drill a well through a body of water without retrieving said bottom hole assembly to the surface of said water, comprising:

storing components for a bottom hole assembly in a submerged storage compartment communicating with a drilling riser adjacent a subsea blowout preventer, and transferring said components of said bottom hole assembly from said storage compartment into an area within said drilling riser to change out said bottom hole assembly in said drill string.

27. A method as defined in claim 26 further comprising holding said stored bottom hole assembly components in a vertical revolving magazine contained within said storage compartment.

28. A method as defined in claim 27 further comprising equalizing pressure between said storage compartment and said area within said drilling riser while said stored components of said bottom hole assembly are being transferred from said storage compartment into said area within said drilling riser.

29. A method as defined in claim 28 further comprising transporting said magazine through said body of water between said storage compartment and a drilling structure at the surface of said body of water.

30. A method as defined in claim 29 further comprising equalizing the pressure between said storage compartment and said body of water as said magazine is being transported into or out of said storage compartment through said body of water.

31. A method as defined in claim 30 further comprising remotely replacing components of the bottom hole assembly of said drill string in said area within said drilling riser with said stored components held by said magazine.

* * * * *